US012662276B2

(12) United States Patent
Biondi et al.

(10) Patent No.: US 12,662,276 B2
(45) Date of Patent: Jun. 23, 2026

(54) DEVICE AND METHOD FOR OPERATING ON PRODUCTS, IN PARTICULAR FOR PACKAGING ARTICLES IN BOXES

(71) Applicant: R.A JONES & CO., Covington, KY (US)

(72) Inventors: Andrea Biondi, Bologna (IT); Luca Cavazza, Bologna (IT); Ivanoe Bertuzzi, Bologna (IT); Valentina Sumini, Bologna (IT)

(73) Assignee: R.A JONES & CO.

( * ) Notice: Subject to any disclaimer, the term of this patent is extended or adjusted under 35 U.S.C. 154(b) by 0 days.

(21) Appl. No.: 18/711,811

(22) PCT Filed: Nov. 22, 2022

(86) PCT No.: PCT/IB2022/061299
§ 371 (c)(1),
(2) Date: May 20, 2024

(87) PCT Pub. No.: WO2023/094999
PCT Pub. Date: Jun. 1, 2023

(65) Prior Publication Data

US 2025/0033814 A1 Jan. 30, 2025

(30) Foreign Application Priority Data

Nov. 24, 2021 (IT) ..... 102021000029762
Nov. 24, 2021 (IT) ..... 102021000029765

(51) Int. Cl.
*B65B 35/26* (2006.01)
*B65B 43/50* (2006.01)

(52) U.S. Cl.
CPC ..... *B65B 35/26* (2013.01); *B65B 43/50* (2013.01)

(58) Field of Classification Search
CPC ... B65B 11/004; B65B 2220/18; B65B 35/26; B65B 43/50; B65B 49/02; B65B 65/02
See application file for complete search history.

(56) References Cited

U.S. PATENT DOCUMENTS 4,276,075 A 6/1981 Olivotto
11,780,200 B2 * 10/2023 Vollenkemper ..... B31B 70/36 156/242

(Continued)

FOREIGN PATENT DOCUMENTS

EP 0933296 A1 8/1999
KR 100597213 B1 7/2006
KR 101965981 B1 8/2019

OTHER PUBLICATIONS

International Search Report and Written Opinion for PCT/IB2022/061299 filed on Nov. 22, 2022 on behalf of R.A Jones & Co. Mail Date: Mar. 14, 2023 10 pages.

*Primary Examiner* — Himchan Song
(74) *Attorney, Agent, or Firm* — Steinfl + Bruno LLP

(57) ABSTRACT

A device for packaging articles in boxes, including a carousel rotatable about a substantially vertical axis of rotation and a frame provided with a first operating unit arranged to operate on one of said articles and/or one of said boxes. The frame is supported and kept raised from the ground by the carousel by a rotatable coupling that allows the relative rotation between the carousel and the frame. The device also includes a fixing structure connected to the frame so that the frame remains fixed with respect to the ground when the carousel rotates around the axis of rotation. A method for packaging articles in boxes is also described.

20 Claims, 8 Drawing Sheets

(56) References Cited

U.S. PATENT DOCUMENTS

Figure 1:
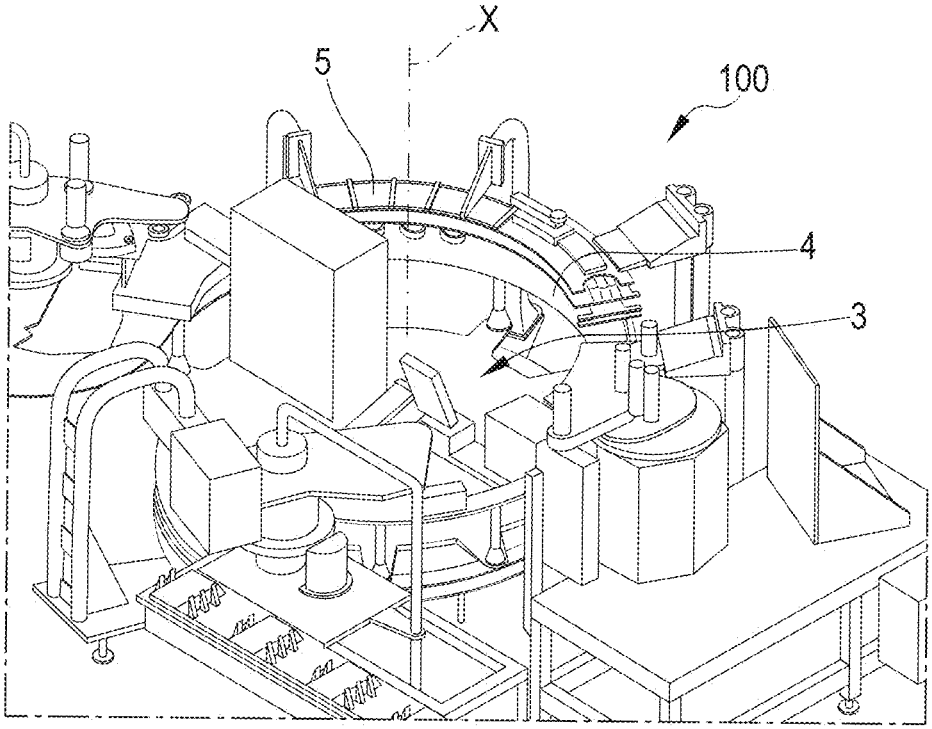

| | | | | |
|---|---|---|---|---|
| 2005/0108992 | A1* | 5/2005 | Wagner | B65G 17/26 53/471 |
| 2005/0223867 | A1 | 10/2005 | Albonetti | |
| 2006/0207220 | A1* | 9/2006 | Ford | B65B 65/003 53/48.8 |
| 2010/0199599 | A1* | 8/2010 | Bonnain | B65B 5/026 53/147 |
| 2011/0232238 | A1* | 9/2011 | May | B65B 43/50 53/235 |
| 2017/0291727 | A1* | 10/2017 | Vollenkemper | B65B 63/02 |
| 2018/0079602 | A1 | 3/2018 | Balletti et al. | |
| 2020/0062434 | A1* | 2/2020 | Schütte | B65B 55/24 |
| 2023/0173781 | A1* | 6/2023 | Carboni | B65B 51/023 493/128 |
| 2023/0182944 | A1* | 6/2023 | Carboni | B65G 47/681 198/418.5 |
| 2023/0227193 | A1* | 7/2023 | Apol | B31B 50/36 53/456 |
| 2023/0312150 | A1* | 10/2023 | Biondi | B65B 29/022 53/410 |

* cited by examiner

DEVICE AND METHOD FOR OPERATING ON PRODUCTS, IN PARTICULAR FOR PACKAGING ARTICLES IN BOXES

CROSS REFERENCE TO RELATED APPLICATIONS

The present application is the U.S. National Stage of International Application No. PCT/IB2022/061299 filed on Nov. 22, 2022, which, in turn, claims priority to Italian Patent Application No. 102021000029762 filed on Nov. 24, 2021 and Italian Patent Application No. 102021000029765 filed on Nov. 24, 2021.

The present invention relates to a device and method for operating on products, in particular for packaging articles in boxes.

The content of the following Patent Applications, filed on the same date by the same Applicant, is considered as herein fully incorporated:

- Italian Patent Application No. 102021000029750 titled "Metodo di confezionamento di articoli in scatole e dispositivo di confezionamento operante secondo tale metodo";
- Italian Patent Application No. 102021000029753 titled "Metodo di confezionamento di articoli in scatole e dispositivo di confezionamento operante secondo tale metodo";
- Italian Patent Application No. 102021000029756 titled "Apparato e processo per la formazione in avvolgimento di una scatola";
- Italian Patent Application No. 102021000029759 titled "Processo e apparato per la formazione in avvolgimento di una scatola";
- Italian Patent Application No. 102021000029762 titled "Dispositivo e metodo per il confezionamento di articoli in scatole"; and
- Italian Patent Application No. 102021000029765 titled "Metodo per operare su prodotti".

The present invention is preferably, though non-exclusively, applied to the field of handling and/or manipulating products, in particular in the field of preparing and packaging articles, preferably articles containing foodstuffs, an example of which is bags containing a cereal-based product such as corn flakes, a product to which reference will be made later without losing in generality.

In particular, in this technical field, they are known machines for packaging articles comprising linear conveyor belts, on which the articles are placed, and operating units arranged along the linear path defined by the aforesaid belts and configured to package the articles in their respective boxes.

They are also known packaging machines comprising a fixed operating surface on which articles may be placed or advanced, and a rotatable structure, also called carousel, provided with working units adapted to operate on these articles.

In the present description as well as in the accompanying claims, certain terms and expressions are deemed to have the meaning expressed in the following definitions, unless expressly stated otherwise.

The term "product" refers to any rigid or deformable object, usually obtained by human labour, on which an operating unit can operate.

The term "article" refers to any object with such a shape that it can be packaged in boxes, i.e. boxed.

The articles may be the same, or they may differ in some characteristic such as size or weight.

Preferably, the articles correspond to closed bags containing food or non-food goods. Preferably, the good contained in the bag is a cereal-based product such as, for example, corn flakes, puffed rice or oat and/or rice flakes.

Preferably, the bags are basically rectangular- or square-shaped.

Preferably, the product corresponds to one of an article, an article at least partially packaged in a box, a box, a box at least partially containing an article, and a set consisting of an article and a box.

The term "operating on a product" refers to any action performed by an operating unit on a product in connection with a product handling process, including actions of modifying, retaining, supporting or moving the product.

The expression "substantially vertical axis of rotation" means that the axis of rotation is extended along a straight line that forms with a horizontal reference plane an angle equal to zero or in any case lower than 20°.

The term "operating section" refers to a portion of a path, or the path itself, where an operating unit is arranged to operate on a product, preferably an article and/or a box.

The term "operating unit" refers to a component, apparatus or device configured to operate on a product, preferably an article and/or a box.

Preferably, the operating unit comprises one of a support surface, a guide, a device for retaining and/or moving a product such as a clamp, a gripper or fixed or movable suction cups, a device for forming a box, such as, for example, a folding device configured to fold a blank around a mandrel, for example a fixed or movable plate, a labelling or printing device, a support device, such as a mandrel or tray, a control device, such as an optical reader or an optical or electromagnetic sensor, a cutting device, such as a blade or saw, a forming device, such as a punch or die, a coupling device, such as a welder or gluing head, or combinations thereof.

The term "operating on an article and/or box" refers to any action on the article and/or box related to a packaging process, including actions of modifying, retaining, supporting or handling the article and/or box.

Preferably, the term "operating on an article and/or box" associated with a component of a device for packaging articles in boxes, such as an operating unit or member, refers to any action that such component performs on the article and/or box related to the packaging process, including actions of modifying, retaining, supporting or handling the article and/or box.

The term "member" refers to a component of an operating unit that is configured to operate, preferably directly, on an article and/or a box.

Preferably, the member comprises a tool or a head of one of the devices listed above with reference to the operating unit intended to operate directly on the product.

The expression "fixed to the ground" or "fixed with respect to the ground" associated with an element, e.g. a frame, means that such an element is fixed directly or indirectly to the ground without being able to move, in particular translate and/or rotate, relative to the ground.

Preferably, the expression "fixed to the ground" or "fixed with respect to the ground" associated with a component of a device for packaging articles in boxes, such as a frame, means that such a component is fixed directly or indirectly to the ground without being able to move, in particular translate and/or rotate, relative to the ground.

The term "mandrel" refers to a container capable, on the one hand, of accommodating and supporting the article to be packaged and, on the other hand, of providing an effective abutment for forming a box around it.

In particular, the formation of a box around the article may be performed according to a "wrap-around" packaging process.

The term "fixing structure" of a component, e.g. a frame, refers to an element, or set of elements, fixed to the ground and connected to the component so as to keep the component fixed with respect to the ground.

The fixing structure may be advantageously constrained to the structure of the building where the apparatus is positioned.

Preferred examples of fixing structures are a base fixed directly or indirectly to the floor or ground, or a beam or bracket fixed directly or indirectly to the ceiling or a wall, or combinations thereof.

Preferably, the expression "connecting stably" a first element to a second element means fixing, i.e. making fixed, stable, stationary, directly or indirectly the first element to the second element, with no possibility of relative movement between the first element and the second element.

The Applicant noted that current machines for operating on products, in particular for packaging articles in boxes, may be disadvantageously bulky due to the arrangement and configuration of its components.

The Applicant further noted that such machines may be provided either with a carousel, provided with one or more operating units configured to operate on a product, or with a support structure designed to bear and keep fixed with respect to the ground a support provided with equipment for handling a product and/or an operating surface on which products may be positioned or advanced.

In particular, the Applicant noted that machines for packaging articles in boxes that include a carousel are also generally provided with a support structure that is fixed to the ground and designed to support and keep fixed with respect to the ground an operating surface on which articles may be placed or advanced.

The Applicant also verified that the existing support structures must be strong enough to bear the weight of the support weighing thereon.

In particular, the Applicant verified that the existing support structures must be strong enough to bear the weight of the operating surface bearing on it.

In addition, the Applicant verified that the proper performance of operations by working units constrained to the carousel on products, in particular articles, present on the aforesaid operating surface is hindered by the presence of the existing support structures that keep the aforesaid operating surface, in particular the support provided by the operating surface, raised from the ground and fixed to it.

The Applicant therefore perceived that the design of the known support structures could be significantly optimised by assigning the task of bearing the operating surface, in particular the support, to another machine component.

Furthermore, the Applicant perceived that the working space intended for operating on products could be increased at the support by removing the existing support structures.

In particular, the Applicant perceived that the operating space attributable to the work units of the machines for packaging articles could be increased at the operating surface by removing the existing support structures.

Such a solution therefore makes it possible to obtain a device for packaging articles in boxes that is provided with a lightened fixing structure to keep an article working surface fixed with respect to the ground and a particularly free working area at the working surface for the operability of operating units.

In addition, such a solution makes it possible to achieve a method for operating on products by means of a first operating unit constrained to the support and at least a second operating unit constrained to the carousel, wherein the support is kept fixed with respect to the ground by means of a lightened support structure.

The Applicant finally found that such advantages may be achieved by means of a device for packaging articles in boxes comprising a carousel rotatable about a substantially vertical axis of rotation and a frame provided with a first operating unit arranged to operate on one or more articles and/or one or more boxes, the frame being supported and kept raised from the ground by the carousel by means of a rotatable coupling allowing for relative rotation between the carousel and the frame.

Furthermore, the Applicant found that such advantages may be achieved by a method for operating on products, wherein it is provided to arrange both a frame, provided with a first operating unit arranged to operate on one of said products, and a carousel rotatable about a substantially vertical axis of rotation and provided with a second operating unit arranged to operate on said one of said products, the frame being rotatably coupled to the carousel so that the frame is supported and kept raised from the ground by the carousel and a relative rotation is allowed between the carousel and the frame. These advantages may be achieved by the aforesaid method also by virtue of connecting a fixing structure stably to the ground and connecting the frame stably to the fixing structure so that the frame remains fixed with respect to the ground by the fixing structure when the carousel rotates about the axis of rotation.

Thus, the present invention, in a first aspect thereof, relates to a device for packaging articles in boxes.

Preferably, the device for packaging articles in boxes comprises a carousel rotatable about an axis of rotation.

Preferably, the axis of rotation is substantially vertical.

Preferably, the device for packaging articles in boxes comprises a frame provided with a first operating unit arranged to operate on one of said articles and/or one of said boxes.

Preferably, the frame is supported and kept raised from the ground by the carousel.

More preferably, the frame is supported and kept raised from the ground by the carousel by means of a rotatable coupling that allows the relative rotation between the carousel and the frame.

Preferably, the device for packaging articles in boxes comprises a fixing structure connected to the frame so that the frame remains fixed with respect to the ground when the carousel rotates around its axis of rotation.

Thanks to these features, the frame is supported and raised from the ground only by the carousel, which is able to rotate with respect to the frame around its own axis of rotation.

This provision therefore makes it possible to use the carousel structure to bear the weight of the frame and of the relative first operating unit, without using additional structural elements independent of the carousel and arranged for such a purpose.

The provision of the fixing structure is also particularly useful to prevent the frame from moving, in particular from rotating, relative to a reference system fixed to the ground during the rotatable movement of the carousel.

It must also be noted that the characteristic of supporting the frame by means of the carousel simplifies the design of the fixing structure, since it only has to perform the function of blocking the frame and not of bearing the weight of the latter.

This is advantageous in terms of size and construction cost of the fixing structure, as it can have a leaner construction than known support structures.

The present invention, in a second aspect thereof, relates to a method for packaging articles in boxes.

Preferably, the method comprises the characteristic of arranging a carousel rotatable around an axis of rotation.

Preferably, the axis of rotation is substantially vertical.

Preferably, the method comprises the characteristic of arranging a frame provided with a first operating unit at the top.

Preferably, the frame has a ring shape.

Preferably, the frame is fixed with respect to the ground.

Preferably, the method comprises the characteristic of arranging a second operating unit comprising a first member and a second member constrained to the carousel.

Preferably, the first member and the second member are constrained to the carousel in a position below the frame.

Preferably, the second member is opposite the first member with respect to the frame.

Preferably, the method comprises the characteristic of rotating the carousel so as to move the second operating unit along a predefined path extended along the frame.

Preferably, the method comprises the characteristic of operating on one of said articles and/or one of said boxes present at the predefined path by the second operating unit.

The provision of a ring-shaped frame and the fact that the second operating unit is moved along the frame, in particular along the annulus delimited by the frame itself, makes it possible to handle articles and/or boxes while keeping the working space of the overall system (i.e. the system comprising frame, carousel and working unit) relatively small, especially in relation to the predominantly longitudinal working spaces provided by the known methods for packaging articles in boxes.

In at least one of the aforesaid aspects, the present invention may also have at least one of the preferred characteristics set forth hereinafter.

In at least one embodiment of the present solution, the device for packaging articles in boxes comprises an electric drive configured to urge the rotation of the carousel around its axis of rotation.

In particular, the electric drive may comprise at least one electric motor, at least one control unit operatively connected to the at least one electric motor for driving the latter and at least one motion transmission system operatively connected to the at least one electric motor and carousel for rotating it based on at least one signal generated by the control unit.

Preferably, the carousel is rotatably coupled to a stand fixed to the floor of the device for packaging articles into boxes.

Preferably, the stand is arranged to support the carousel, particularly during its rotation around its axis of rotation.

In at least one embodiment of the present solution, the frame is provided with the first operating unit at the top.

In at least one embodiment of the present solution, the first operating unit is arranged to operate on one of said articles and/or one of said boxes present at an area above the frame.

In at least one embodiment of the present solution, the first operating unit comprises a working surface on which one of said articles and/or one of said boxes may be placed and/or advanced.

Preferably, the working surface has a predominantly horizontal extension.

Preferably, the working surface faces upwards.

Preferably, the first operating unit comprises a support surface provided with the working surface.

Preferably, the support surface is rigidly connected to the frame.

In at least one embodiment of the present solution, the device for packaging articles in boxes comprises a plurality of first working units mounted on the frame.

In at least one embodiment of the present solution, the device for packaging articles in boxes comprises a second operating unit.

Preferably, the second operating unit is arranged to operate on one of said articles and/or one of said boxes.

Preferably, the second operating unit comprises a mandrel.

Preferably, the second operating unit comprises a first member connected to a portion of the carousel below the frame.

The area above the frame thereby remains substantially free and accessible for operating on an article and/or box present in that area by the second operating unit and/or other mechanisms for handling articles and/or boxes.

Preferably, the rotation of the carousel around the axis of rotation moves the second operating unit along a predefined path.

Preferably, the first operating unit is arranged at the predefined path.

Preferably, the working surface of the first operating unit is extended at least partially along the predefined path.

In at least one embodiment of the present solution, the first member is arranged at least partially beyond the frame with respect to the axis of rotation of the carousel so that the first operating unit is extended between the axis of rotation and the first member in at least one operating section of the predefined path.

Therefore, in this circumstance the first member is arranged outside the frame with respect to the axis of rotation of the carousel at least in the operating section of the predefined path.

This makes it advantageously possible to minimise the radial distance between the carousel axis of rotation and the first operating unit (in particular between the carousel axis of rotation and the support surface), resulting in a device for packaging boxes that is improved in terms of overall dimensions.

In at least one embodiment of the present solution, the operating section of the predefined path is extended at least partially along a section of the support surface and, preferably, has the same shape.

In at least one embodiment of the present solution, the first member is configured to operate in the operating section on one of the aforesaid articles and/or one of the aforesaid boxes during the movement of the second operating unit along the predefined path when one of the aforesaid articles and/or one of the aforesaid boxes are/is at the operating section.

This characteristic is particularly useful for processing the article and/or the box present in the operating section by the first member while it is rotated by the carousel.

In at least one embodiment of the present solution, the second operating unit comprises a second member connected to the portion of the carousel below the frame and arranged on the side opposite the first member with respect to the frame.

Therefore, in this circumstance, the frame is interposed between the first member and the second member and is above a portion of the carousel that supports the second operating unit.

It must be noted that the provision of a second member makes it possible to increase the versatility of the second operating unit and its ability to operate on an article and/or box.

Preferably, the first member and the second member comprise a first portion and, respectively, a second portion of a mandrel.

In at least one embodiment of the present solution, the first operating unit is extended between the first member and the second member in at least one operating section of the predefined path.

Preferably, this operating section matches with the previously mentioned operating section.

In other words, the first operating unit is interposed between the first member and the second member in the operating section.

This provision allows the second operating unit to intervene on a present article and/or box from two opposite areas of the operating section.

In at least one embodiment of the present solution, the first member and the second member are configured to operate jointly in the operating section on one of the aforesaid articles and/or one of the aforesaid boxes during the movement of the second operating unit along the predefined path when one of the aforesaid articles and/or one of the aforesaid boxes are/is at the operating section.

This characteristic is particularly useful for processing the article and/or box present in the operating section by the first member and the second member while they are driven in rotation by the carousel.

In at least one embodiment of the present solution, the first member and/or the second member comprise/comprises a relative head adapted to operate on an article and/or box present on the working surface of the first operating unit.

Preferably, the head is above the working surface in the operating section, more preferably the head is above the working surface at least in the operating section.

Therefore, in this circumstance the first member and/or the second member may easily and directly act on the article and/or the box present on the working surface by means of the relative head.

In at least an embodiment of the present solution, the head of the first member and/or the second member is adapted to retain an end of an article and/or a box, preferably at least when the relevant second operating unit is in the operating section.

In particular, the head may comprise a base and a pair of sidewalls jointly defining a seat configured to accommodate and support an end of the article and/or box.

Preferably, the base and pair of the head sidewalls is adapted to retain and support one end of an article and to provide an appropriate abutment while forming a box around it.

Preferably, the head of the first member defines a first portion of a mandrel.

Preferably, the head of the second member defines a second portion of a mandrel.

Preferably, the head of the first member and the head of the second member jointly define a mandrel.

In addition or alternatively, the head may comprise a piston that slides into its seat and adapted to hold an article in place when it is accommodated in the seat.

This provision makes it possible to improve the grip of the article and/or the box by the second operating unit.

In addition or alternatively, the head may comprise a gripper adapted to grip one end of the article and/or box in the operating section.

In at least one embodiment of the present solution, the device for packaging articles in boxes comprises a plurality of second operating units, preferably arranged radially with respect to the axis of rotation of the carousel.

This characteristic is particularly useful to increase the number of actions that may be performed on an article and/or box present at the operating section.

The operating units of the plurality of operating units comprise the first member and, preferably, the second member.

In at least one embodiment of the present solution, the frame comprises an annular groove and the carousel comprises at least one upright adapted to rotatably support the frame by means of at least one roller constrained to the upright and sliding in the said annular groove.

Preferably, the carousel comprises a base from which the upright, preferably a plurality of uprights spaced apart from each other, is extended along a vertical direction to a free end thereof to which the at least one roller is restrained with the ability to rotate, preferably around a substantially horizontal axis.

The at least one roller may therefore slide in the annular groove of the frame as the carousel rotates so as to allow the relative rotation between the carousel and the frame and, at the same time, the support of the frame by the carousel.

In at least one embodiment of the present solution, the frame is rotatably coupled to the carousel by means of a fifth wheel.

Preferably, the fifth wheel comprises a concentric inner ring and outer ring having an axis passing through their centre and preferably extending along a substantially vertical direction.

Preferably, the fifth wheel comprises rotating elements interposed between the inner ring and the outer ring that allow a relative rotation between said rings.

Preferably, the rotating elements comprise at least one of balls and cylinders, or combinations thereof.

Preferably, one of the inner ring and the outer ring is rigidly connected to, or is part of, the frame and the other of the inner ring and the outer ring is rigidly connected to, or is part of, the carousel.

Preferably, the frame is fixed to the outer ring while the inner ring of the fifth wheel is fixed to a base of the carousel by at least one arm, more preferably a plurality of arms, each one extended longitudinally from the base of the carousel to the inner ring of the fifth wheel. Preferably, the arms are extended radially with respect to the axis of rotation of the carousel.

The provision of a fifth wheel to couple the frame to the carousel is particularly useful in order to use the device for packaging articles in boxes in particularly dusty environments, a condition that may arise, for example, if the articles correspond to closed bags containing cereal-based products such as, for example, corn flakes, puffed rice or oat and/or rice flakes.

In fact, the rotating elements of the fifth wheel are enclosed within a seat obtained between the inner ring and the outer ring that protects these elements from dust and dirt.

In at least one embodiment of the present solution, the frame is rotatably coupled to the carousel by means of a circular guide.

Preferably, the circular guide comprises a rail and at least one slide integral with the frame and the other with the carousel.

At least one slide slides on the rail of the circular guide.

Preferably, the rail is fixed to the frame while a plurality of slides are fixed to a base of the carousel by respective arms, each one extended longitudinally from the carousel base to the respective slide.

Preferably, the arms are extended radially with respect to the axis of rotation of the carousel.

In at least one embodiment of the present solution, the portion of the carousel below the frame, which is connected to the first member and the second member (if any) of the second operating unit, is extended from the base of the carousel.

In at least one embodiment of the present solution, the frame comprises a ramp extended longitudinally from a first end to a second end thereof above the first end.

Preferably, the second end is substantially coplanar to the working surface of the first operating unit.

This characteristic is particularly useful in order to case the positioning on the working surface of an article and/or box coming from a path, or zone, placed at a lower height than the working surface.

In fact, in this case, the article and/or box may be slided down the ramp until reaching the second end and then the working surface without interruption.

In at least one embodiment of the present solution, the frame is ring-shaped.

This characteristic is particularly useful in view of the fact that the carousel rotates around a substantially vertical axis of rotation.

Preferably, the axis of rotation of the carousel passes through the centre of the ring shape of the frame.

Preferably, the frame comprises, or consists of, a single-piece body.

Preferably, the frame, more preferably the single-piece body of the frame, comprises a plurality of lightening holes arranged so as to reduce the overall weight of the frame without compromising the required structural rigidity.

Therefore, in this circumstance, the carousel is required to support a lightened frame, resulting in an advantage in terms of the construction of the carousel itself.

In fact, the mass of the carousel may be reduced due to the lower weight of the frame to be supported, thus obtaining an advantage in terms of less inertia in the movement of the carousel.

In at least one embodiment of this solution, the working surface of the first operating unit comprises at least one curvilinear portion.

This provision is particularly suitable for the rotary movement of the carousel around its axis of rotation.

Preferably, the working surface comprises an extended portion according to an annulus section.

In at least one embodiment of the present solution, the predefined path comprises an extended portion according to an annulus section or the predefined path has a ring shape.

In at least one embodiment of this solution, the operating section comprises at least a curvilinear portion of the predefined path.

Preferably, the operating section comprises an extended portion according to an annulus section.

Preferably, the operating section is extended along at least a portion of the working surface.

In at least one embodiment of the present solution, the fixing structure comprises a support with a predominantly vertical extension fixed to the ground and an arm integrally extended from the support and rigidly connected to an upper portion of the frame.

Preferably, the support is arranged outside the frame with respect to the axis of rotation of the carousel.

Preferably, the arm comprises an arc-shaped portion with the concavity directed downwards.

In at least one embodiment of the present solution, the fixing structure is connected to a portion of the frame not affected by the operating section of the predefined path.

The fixing structure thereby does not hinder the operability of the one or more operating units preferably present in the device for packaging articles in boxes.

According to an embodiment of the present Application, a device for packaging articles in boxes is described as comprising a fixed annular-shaped frame, the frame comprising a support surface for supporting said articles and/or boxes; an annular-shaped carousel below the frame, coupled to the frame and rotatable with respect to the frame; and one or more operating units connected to the carousel to rotate with respect to the frame when the carousel is rotating, each operating unit comprising an member, arranged above the frame and rotatable around the frame above the support surface.

According to an embodiment of the present Application, a method is described for packaging articles in boxes moving along an annular path on a fixed frame, the frame being vertically arranged between operating units rotatable above the frame and a carousel arranged below the frame, the method comprising: rotating the carousel so as to move the operating units along the annular path; and operating, during the rotation of the carousel, by means of the operating units on the articles and/or boxes along the annular path.

The present invention, in a third aspect thereof, relates to a method for operating on products.

Preferably, the method is for packaging articles in boxes.

Preferably, the method comprises arranging a frame provided with a first operating unit arranged to operate on one of these products.

Preferably, the method comprises arranging a carousel rotatable around an axis of rotation.

Preferably, said axis of rotation is substantially vertical.

Preferably, said carousel is provided with a second operating unit arranged to operate on said one of said products.

Preferably, the method comprises rotatably coupling said frame to said carousel so that said frame is supported and kept raised from the ground by said carousel and a relative rotation is made possible between said carousel and said frame.

Preferably, the method comprises connecting a fixing structure stably to the ground.

Preferably, the method comprises connecting said frame stably to said fixing structure so as to keep said frame fixed to the ground by said fixing structure when said carousel rotates around said axis of rotation.

Preferably, the method comprises moving said one of said products along a predefined path.

Preferably, said predefined path passes through said first operating unit.

Preferably, the method comprises rotating said carousel around said axis of rotation.

Preferably, the method comprises operating on said one of said products by said first operating unit and said second operating unit.

Thanks to these features, the frame is supported and raised from the ground only by the carousel, which is able to rotate with respect to the frame around its own axis of rotation.

Possible frictional forces occurring between the frame and the carousel during the rotation of the latter could cause the frame to rotate relative to a reference system fixed to the ground, however, the frame rotation is prevented by connecting the frame to the fixing structure.

Therefore, the characteristic of supporting the frame by means of the carousel simplifies the design of the fixing structure, as this only has to perform the function of blocking the frame and not of bearing the weight of the latter.

This is advantageous in terms of size and construction cost of the fixing structure, as it can have a leaner construction than known support structures.

The provision of moving the product along a predefined path passing through the first operating unit allows the latter to easily operate on the product, particularly when it is arranged at the first operating unit.

The provision of rotating the carousel around its own axis of rotation allows the second operating unit to be arranged at the product so that it can operate particularly easily thereon.

The present invention, in a fourth aspect thereof, relates to a device for operating on products.

Preferably, the device for operating on products comprises a frame provided with a first operating unit arranged to operate on one of said products.

Preferably, the device comprises a carousel rotatable around an axis of rotation.

Preferably, said axis of rotation is substantially vertical.

Preferably, said carousel is provided with a second operating unit arranged to operate on said one of said products.

Preferably, said carousel is rotatably coupled to said frame so that said frame is supported and kept raised from the ground by said carousel and a relative rotation is allowed between said carousel and said frame.

Preferably, said device comprises a fixing structure stably connected to the ground.

Preferably, said frame is stably connected to said fixing structure so as to keep said frame fixed with respect to the ground by means of said fixing structure when said carousel rotates around said axis of rotation.

Preferably, said first operating unit is arranged to operate on said one of said products when it is present in a predefined path.

Preferably, said predefined path passes through said first operating unit.

Preferably, said second operating unit is arranged to operate on said one of said products when it is present in said predefined path.

Thanks to these characteristics, the frame is supported and raised from the ground by the carousel and the product present in the predefined path may be handled by the first operating unit and/or the second operating unit as the carousel rotates around its own axis of rotation.

In at least one of the aforesaid aspects, the present invention may also have at least one of the preferred characteristics set forth hereinafter.

Preferably, the device for operating on products corresponds to a device for packaging articles in boxes.

More generally, the device for operating on products may correspond to any device, or machine, capable of performing actions in relation to a product handling process, including actions of modifying, retaining, supporting or moving the product, by means of the first operating unit and/or the second operating unit.

The device for operating on products may therefore also correspond to a machine adapted to perform product finishing functions such as, for example, treating the external surface of the product (for instance, for exemplary purposes, colouring, painting, applying prints or making prints on the surface), or a device arranged to modify the product by adding, displacing or removing product components.

In at least one embodiment of the present solution, the device for operating on products comprises an electric drive configured to urge the carousel to rotate around its axis of rotation.

In particular, the electric drive may comprise at least one electric motor, at least one control unit operatively connected to the at least one electric motor for driving the latter and at least one motion transmission system operatively connected to the at least one electric motor and carousel for rotating it based on at least one signal generated by the control unit.

Preferably, the carousel is rotatably coupled to a stand fixed to the floor of the device for packaging articles into boxes.

Preferably, the stand is arranged to support the carousel, particularly during its rotation around its axis of rotation.

In at least one embodiment of the present solution, the method of operating on products comprises urging the carousel to rotate around its axis of rotation by means of an electric drive.

In at least one embodiment of the present solution, the characteristic of moving one of the products along the predefined path comprises placing and/or advancing one of the products in an area above the frame.

The product does not thereby interfere with anything that can be arranged under the frame.

In at least one embodiment of the present solution, the method for operating on products provides that the first operating unit is arranged on top of the frame.

Preferably, the second operating unit comprises a first member connected to a portion of the carousel below the frame.

This characteristic is particularly useful so that the first operating unit does not to interfere with the movement of the carousel.

In addition, the area above the frame remains substantially free and accessible for operating on at least one product by means of the first operating unit and the second operating unit.

Preferably, the first operating unit comprises a working surface on which one of said products may be placed and/or advanced.

Preferably, the working surface has a predominantly horizontal extension.

Preferably, the working surface faces upwards.

Preferably, the first operating unit comprises a support surface provided with the working surface.

Preferably, the support surface is rigidly connected to the frame.

Preferably, the frame is provided with a plurality of first working units, most preferably arranged in sequence along the predefined path.

Preferably, the first operating unit comprises a box-forming device, such as a device configured to fold a blank around a mandrel, or a gluing, or labelling or printing device.

Preferably, the second operating unit comprises a mandrel.

In at least one embodiment of the present solution, the rotation of the carousel around its axis of rotation moves the second operating unit along the predefined path.

Therefore, in this circumstance, the second operating unit is placed in the predefined path where one of the aforesaid products is moved. The second operating unit is thus facilitated in carrying out operations on the product, cooperating with the first operating unit.

In at least one embodiment of the present solution, the first member is arranged at least partially beyond the frame with respect to the axis of rotation of the carousel so that the first operating unit is extended between the axis of rotation and the first member in at least one operating section of the predefined path.

Therefore, in this circumstance the first member is arranged outside the frame with respect to the axis of rotation of the carousel at least in the operating section of the predefined path.

This allows to advantageously minimise the radial distance between the axis of rotation of the carousel and the first operating unit, obtaining, as a consequence, a device and method for operating on products requiring a relatively small working space.

In at least one embodiment of the present solution, the characteristic of operating on one of the products via the first operational unit and the second operating unit is carried out in the operating section.

In other words, the first operating unit and the second operating unit operate on one of the products in the operating section of the predefined path.

In at least one embodiment of the present solution, the second operating unit comprises a second member connected to the portion of the carousel below the frame and arranged on the side opposite the first member with respect to the frame.

Therefore, in this circumstance, the frame is interposed between the first member and the second member and is above a portion of the carousel that supports the second operating unit.

It must be noted that the provision of a second member allows to increase the versatility of the second operating unit and its ability to operate on a product.

Preferably, the first member and the second member comprise a first portion and, respectively, a second portion of a mandrel.

In at least one embodiment of the present solution, the first operating unit is extended between the first member and the second member in at least one operating section of the predefined path.

Preferably, this operating section matches with the previously mentioned operating section.

In other words, the first operating unit is interposed between the first member and the second member in the operating section.

Such provision allows the second operating unit to intervene on the product from two opposite areas of the operating section.

In at least one embodiment of the present solution, the carousel is provided with a plurality of second operating units, preferably arranged radially with respect to the axis of rotation of the carousel.

This characteristic is particularly useful to increase the number of actions that may be performed on one or more products at the operating section.

The operating units of the plurality of second operating units comprise the first member and, preferably, the second member.

In at least one embodiment of the present solution, the characteristic of moving one of the products along the predefined path comprises placing and/or advancing one of the products on the working surface of the first operating unit.

This provision is particularly useful if the first operating unit comprises the working surface provided with the aforesaid working surface.

In at least one embodiment of the present solution, the characteristic of operating on the product by means of the first operating unit and the second operating unit comprises supporting the product by the working surface.

This is particularly useful when the product is an article at least partially packaged in a box.

Preferably, the product is supported by the first operating unit.

Preferably, the product is supported by the working surface during the movement of the product along the entire predefined path, more preferably during the movement of the product along the entire predefine path.

In at least one embodiment of the present solution, the first member and/or the second member comprise/comprises a relative head adapted to operate on a product present in the predefined path, in particular on the working surface of the first operating unit.

In at least one embodiment of the present solution, the head of the first member and/or the second member is adapted to retain an end of a product, preferably at least when the relative second operating unit is in the operating section.

In particular, the head may comprise a base and a pair of sidewalls jointly defining a seat configured to accommodate and support one end of the product.

Preferably, the base and pair of the head sidewalls is adapted to retain and support one end of an article and to provide an appropriate abutment while forming a box around it.

Preferably, the head of the first member defines a first portion of a mandrel. Preferably, the head of the second member defines a second portion of a mandrel.

Preferably, the head of the first member and the head of the second member jointly define a mandrel.

In addition or in alternative, the head may comprise a piston sliding in the relative seat and adapted to hold a product, in particular an article, in place when it is accommodated in the seat.

This provision makes it possible to improve the grip of the product by the second operating unit.

In addition or in alternative, the head may comprise a gripper adapted to grip one end of the product in the predefined path, particularly in the working section.

In at least one embodiment of the present solution, the characteristic of operating on the product by means of the first operating unit and the second operating unit comprises retaining one end of the product by means of a head of the first member and/or a head of the second member of the second operating unit.

Preferably, the head is above the working surface in the operating section, more preferably the head is above the working surface at least in the operating section.

Therefore, in this circumstance, the first member and/or the second member may easily and directly act on the product present in the predefined path, in particular on the working surface by means of the relative head.

In at least one embodiment of the present solution, the frame comprises an annular groove and the carousel includes at least one upright.

Preferably, the at least one upright is adapted to rotatably support the frame by means of at least one roller constrained to the upright and sliding in the aforesaid annular groove.

In at least one embodiment of the present solution, the characteristic of rotatably coupling the frame to the carousel comprises supporting the frame by means of at least one roller constrained to the at least one upright and sliding in the annular groove.

Preferably, the carousel comprises a base from which the upright, preferably a plurality of uprights spaced apart from each other, is extended along a vertical direction to a free end thereof to which the at least one roller is restrained with the ability to rotate, preferably around a substantially horizontal axis.

The at least one roller may therefore slide in the annular groove of the frame as the carousel rotates so as to allow the relative rotation between the carousel and the frame and, at the same time, the support of the frame by the carousel.

Preferably, the portion of the carousel below the frame, which is connected to the first member and the second member (if any) of the second operating unit, is extended from the base.

In at least one embodiment of the present solution, the frame is rotatably coupled to the carousel by means of a fifth wheel.

Preferably, the fifth wheel comprises a concentric inner ring and outer ring having an axis passing through their centre and preferably extending along a substantially vertical direction.

Preferably, the fifth wheel comprises rotating elements interposed between the inner ring and the outer ring that allow a relative rotation between said rings.

Preferably, the rotating elements comprise at least one of balls and cylinders, or combinations thereof.

Preferably, one of the inner ring and the outer ring is rigidly connected to, or is part of, the frame and the other of the inner ring and the outer ring is rigidly connected to, or is part of, the carousel.

Preferably, the frame is fixed to the outer ring while the inner ring of the fifth wheel is fixed to a base of the carousel by at least one arm, more preferably a plurality of arms, each one extended longitudinally from the base of the carousel to the inner ring of the fifth wheel. Preferably, the arms are extended radially with respect to the axis of rotation of the carousel.

The provision of a fifth wheel to couple the frame to the carousel is particularly useful in order to use the device for packaging articles in boxes in particularly dusty environments, a condition that may arise, for example, if the articles correspond to closed bags containing cereal-based products such as, for example, corn flakes, puffed rice or oat and/or rice flakes.

In fact, the rotating elements of the fifth wheel are enclosed within a seat obtained between the inner ring and the outer ring that protects these elements from dust and dirt.

In at least one embodiment of the present solution, the frame is rotatably coupled to the carousel by means of a circular guide.

Preferably, the circular guide comprises a rail and at least one slide integral with the frame and the other with the carousel.

At least one slide slides on the rail of the circular guide.

Preferably, the rail is fixed to the frame while a plurality of slides are fixed to a base of the carousel by respective arms, each one extended longitudinally from the carousel base to the respective slide.

Preferably, the arms are extended radially with respect to the axis of rotation of the carousel.

In at least one embodiment of the present solution, the portion of the carousel below the frame, which is connected to the first member and the second member (if any) of the second operating unit, is extended from the base of the carousel.

In at least one embodiment of the present solution, the method for operating on products comprises arranging a ramp extended longitudinally from one first end to one second end thereof in such a way that the second end is above the first end and substantially coplanar with the working surface.

This characteristic is particularly useful in order to position on the working surface a product coming from a path, or zone, located at a lower height than the working surface.

In fact, in this case, the product may be slided down the ramp until reaching the second end and then the working surface without interruption.

In at least one embodiment of the present solution, the frame is ring-shaped.

This characteristic is particularly useful in view of the fact that the carousel rotates around a substantially vertical axis of rotation.

Preferably, the axis of rotation of the carousel passes through the centre of the ring shape of the frame.

Preferably, the frame comprises, or consists of, a single-piece body.

Preferably, the frame, more preferably the single-piece body of the frame, comprises a plurality of lightening holes arranged so as to reduce the overall weight of the frame without compromising the required structural rigidity.

Therefore, in this circumstance, the carousel is required to support a lightened frame, resulting in an advantage in terms of the construction of the carousel itself.

In fact, the mass of the carousel may be reduced due to the lower weight of the frame to be supported, thus obtaining an advantage in terms of less inertia in the movement of the carousel.

In at least one embodiment of this solution, the working surface of the first operating unit comprises at least one curvilinear portion.

This provision is particularly suitable for the rotary movement of the carousel around its axis of rotation.

Preferably, the working surface comprises an extended portion according to an annulus section.

In at least one embodiment of the present solution, the predefined path comprises an extended portion according to an annulus section or the predefined path has a ring shape.

In at least one embodiment of this solution, the operating section comprises at least a curvilinear portion of the predefined path.

Preferably, the operating section comprises an extended portion according to an annulus section.

Preferably, the operating section is extended along at least a portion of the working surface.

In at least one embodiment of the present solution, the fixing structure comprises a support with a predominantly vertical extension fixed to the ground and an arm integrally extended from the support and rigidly connected to an upper portion of the frame.

Preferably, the support is arranged outside the frame with respect to the axis of rotation of the carousel.

Preferably, the arm comprises an arc-shaped portion with the concavity directed downwards.

In at least one embodiment of the present solution, the fixing structure is connected to a portion of the frame not affected by the operating section of the predefined path.

Thus, the fixing structure does not hinder the operability of the one or more operating units preferably associated with the frame and/or carousel.

It must be specified that some steps of the method described above may be independent of the order of execution reported. In addition, some steps may be optional. Furthermore, some steps of the method may be performed repetitively, or they may be performed in series or in parallel with other steps of the method.

Figure 2:
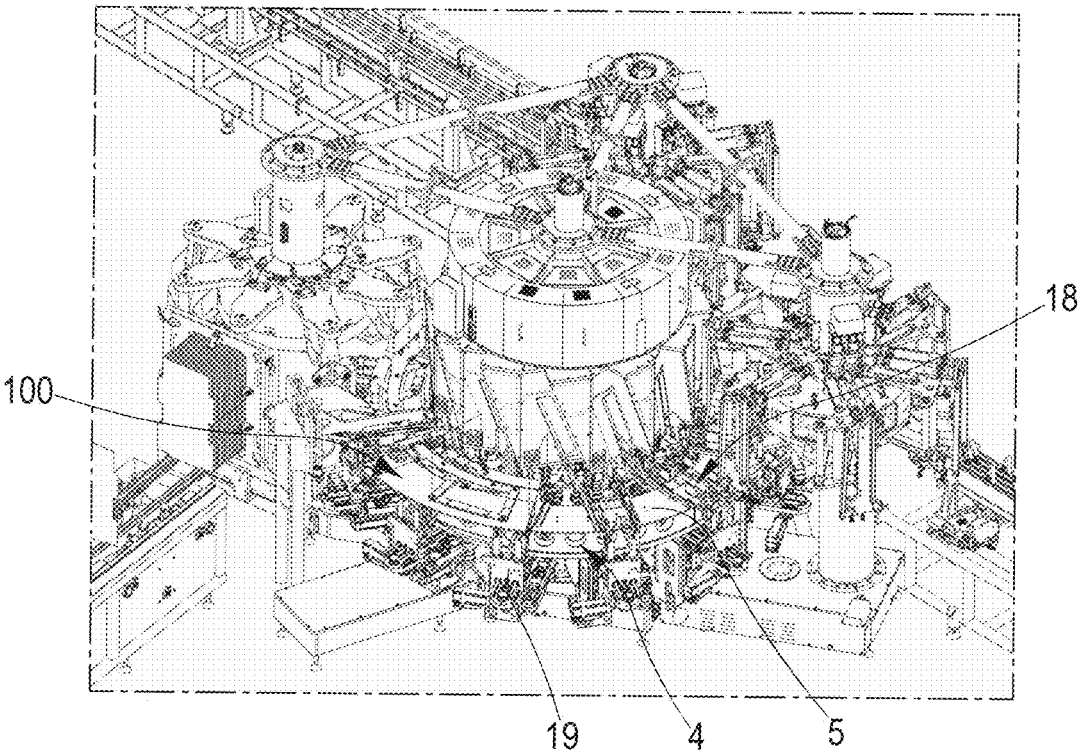
Figure 3:
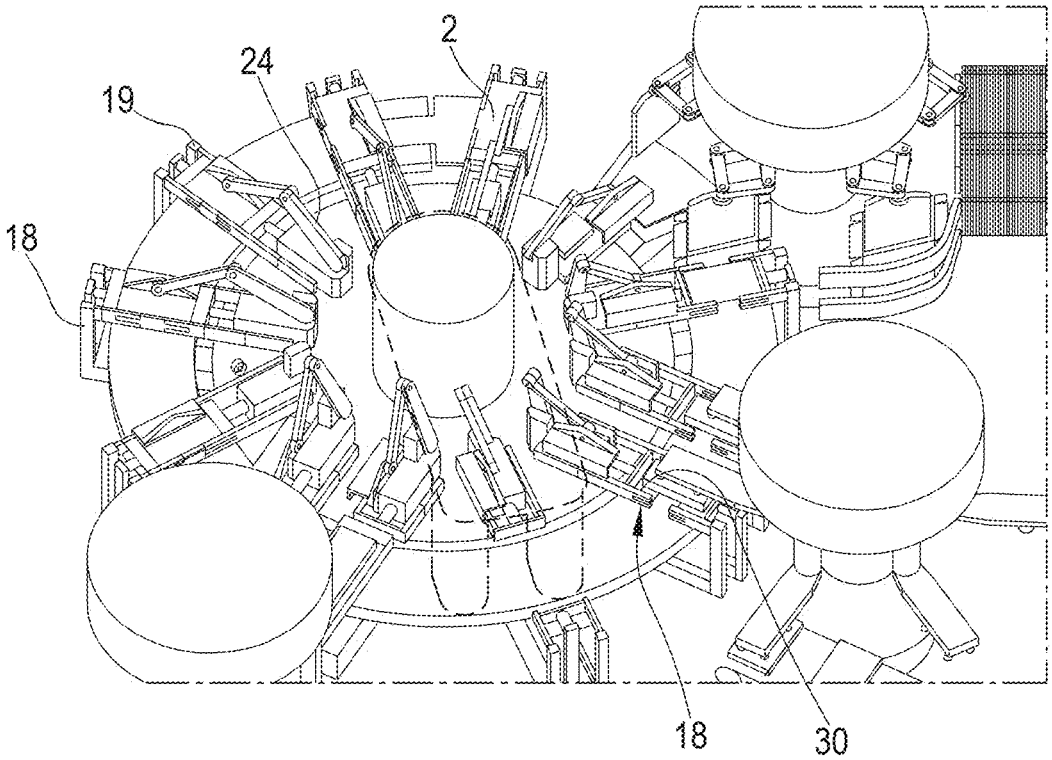
Figure 4:
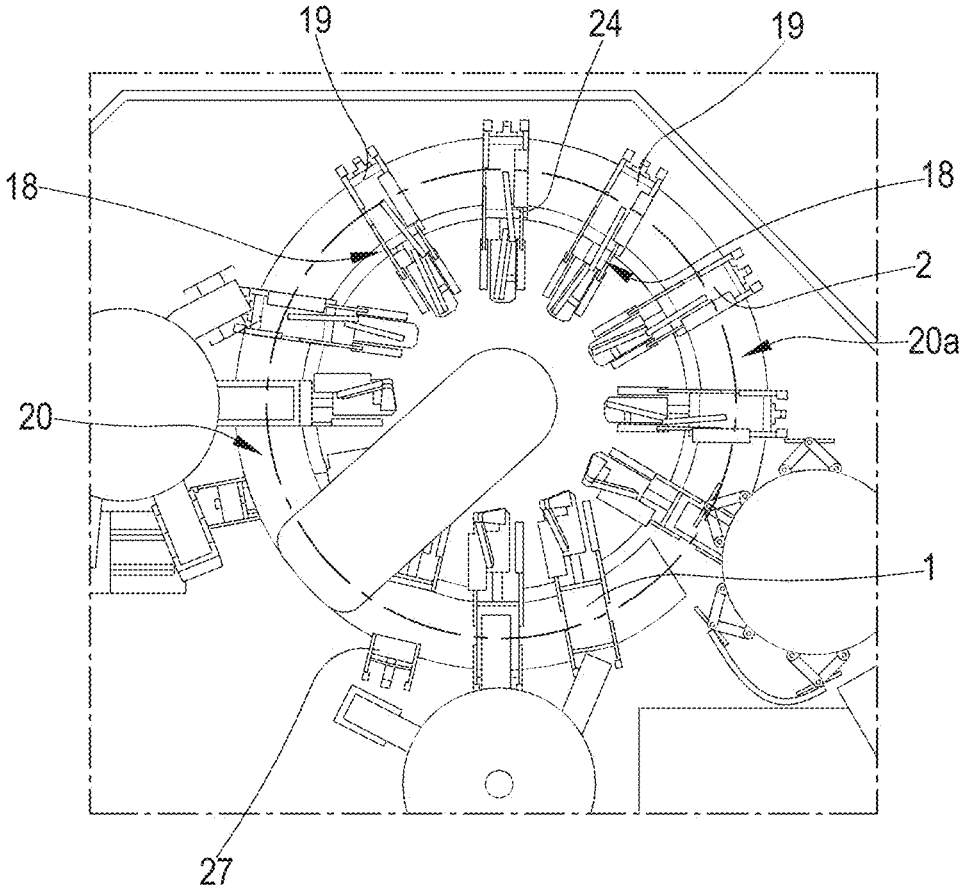
Figure 10:
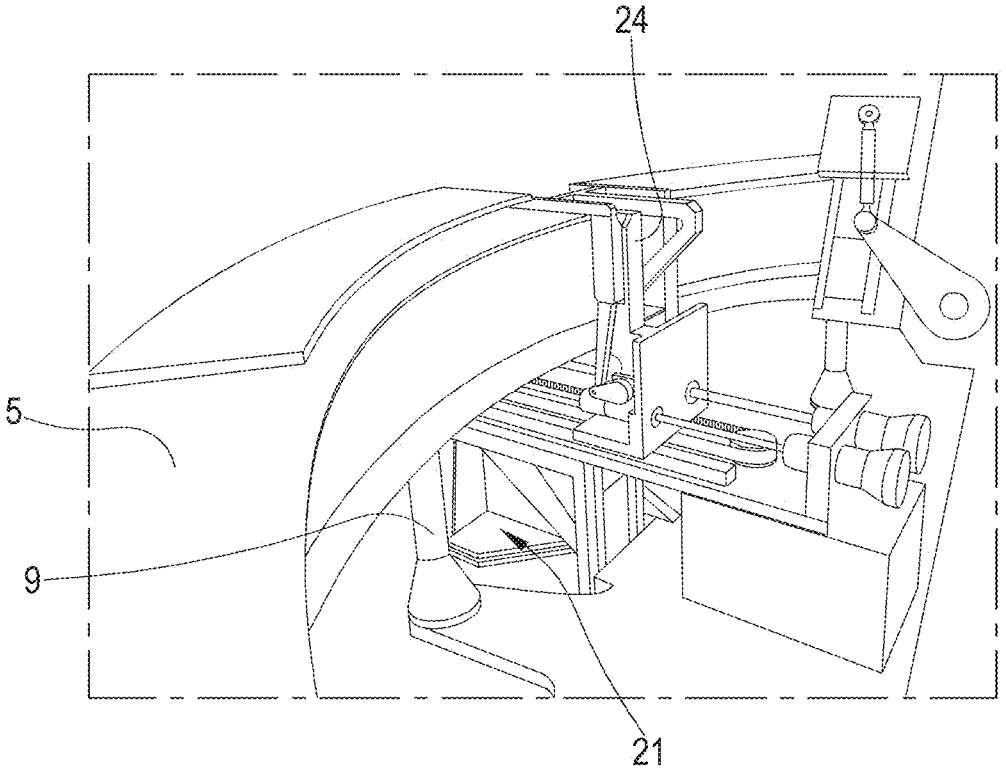
Figure 11:
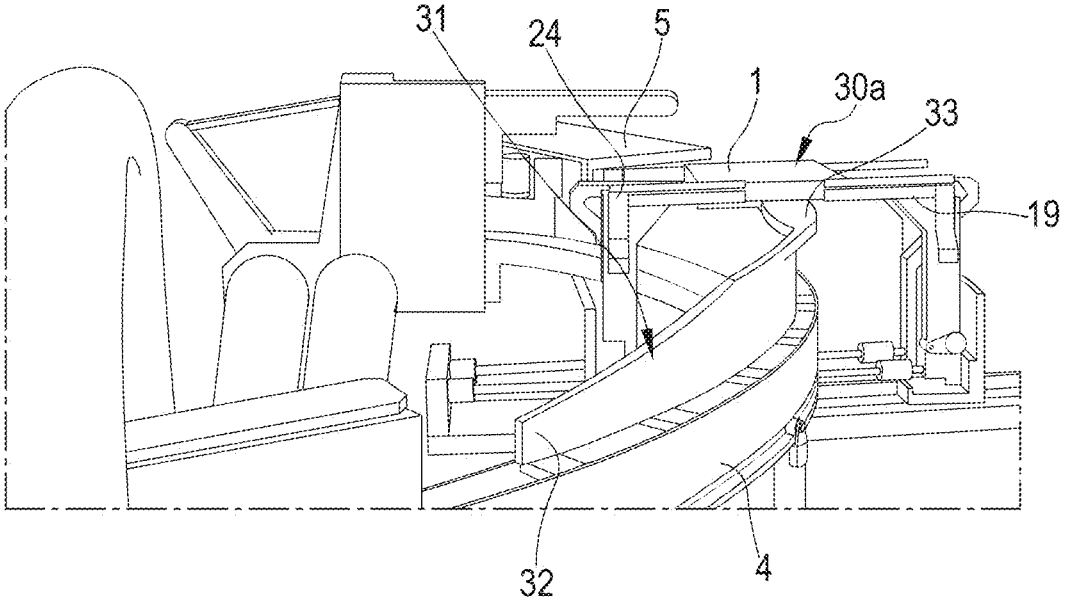
Figure 12:
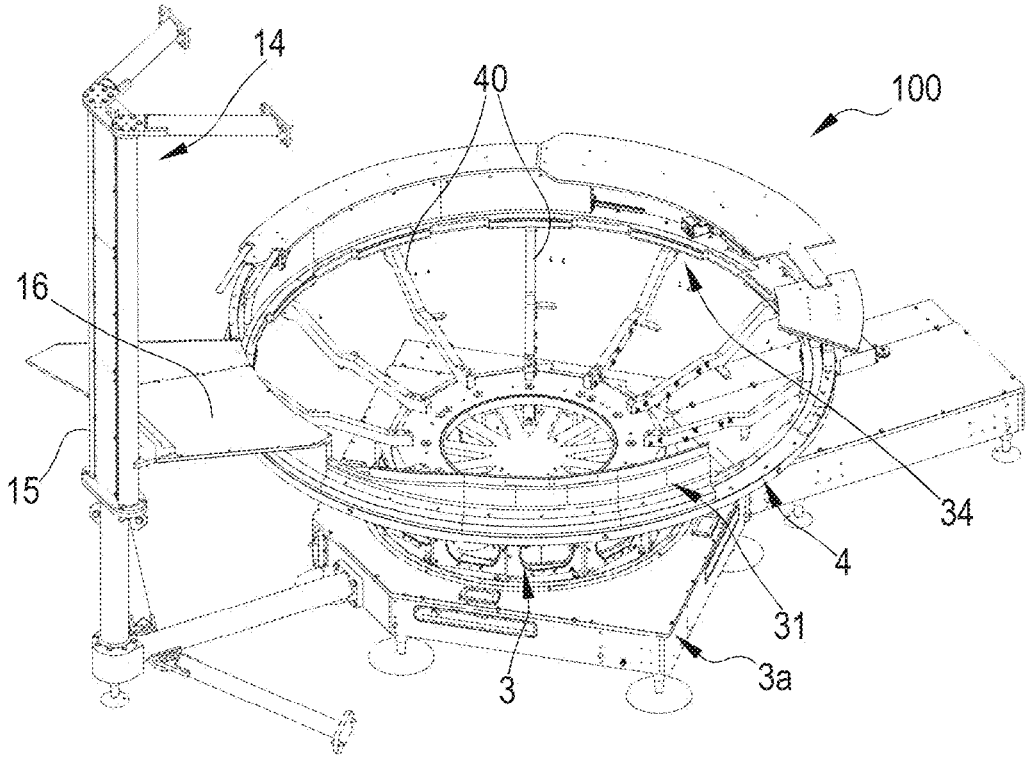
Figure 13:
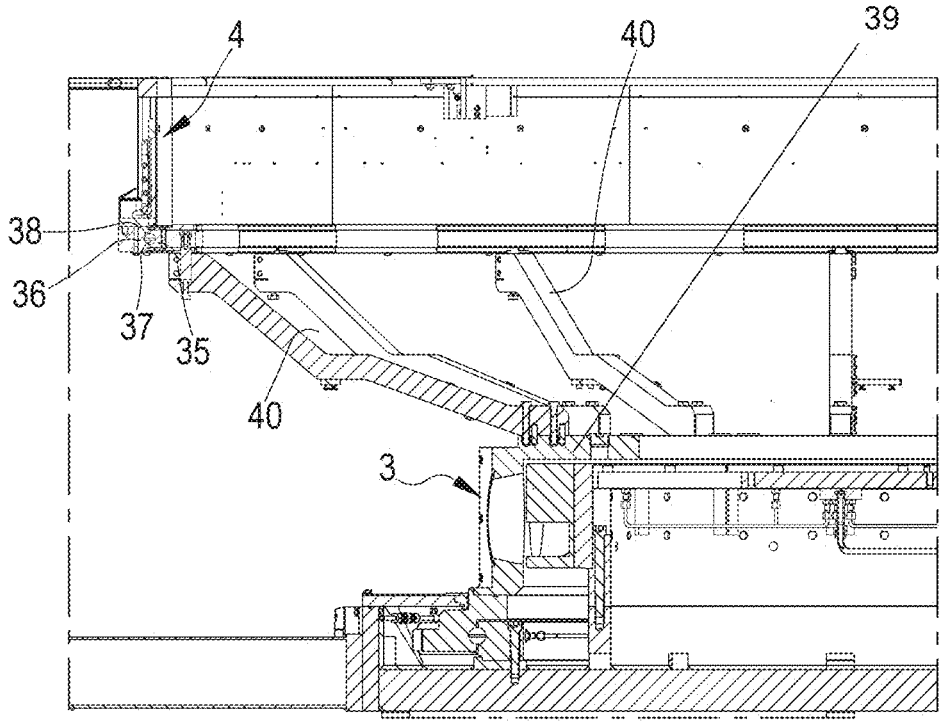
Figure 14:
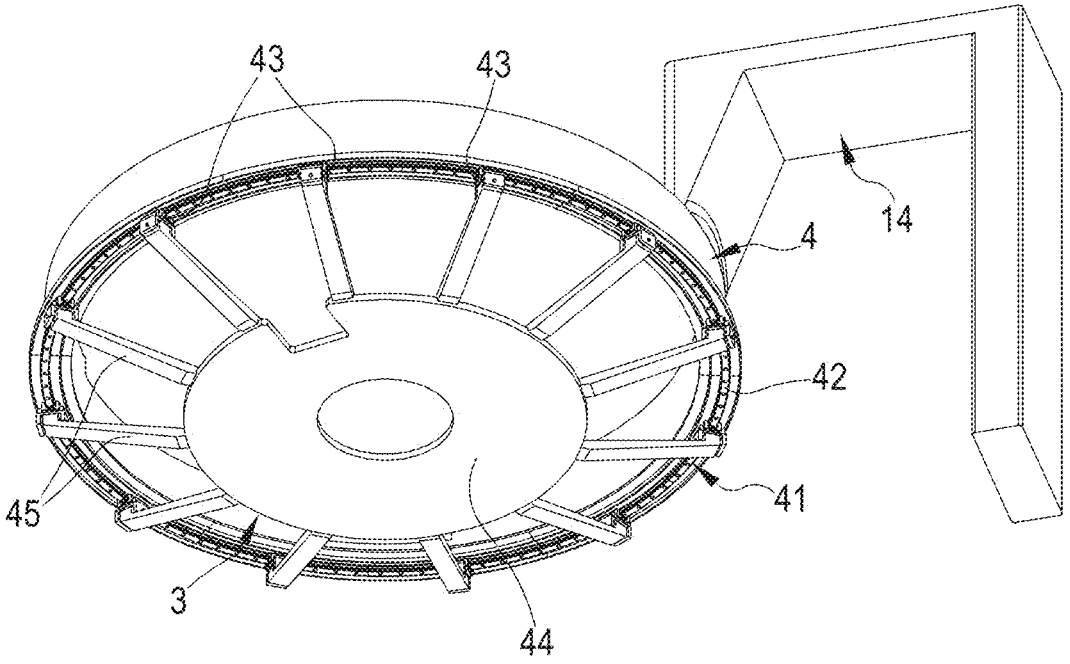

The characteristics and advantages of the present solution will become clearer from the detailed description of a preferred embodiment thereof shown, by way of non-limiting example, with reference to the appended drawings wherein:

FIG. 1 is a schematic perspective view of a device for operating on products, in particular for packaging articles in boxes, according to an embodiment of the present solution, FIG. 2 is a schematic perspective view of a device for operating on products, in particular for packaging articles in boxes, according to a second embodiment of the present solution, FIGS. 3 and 4 are a perspective and, respectively, plan view of a device for operating on products, in particular for packaging articles in boxes, according to a further embodiment of the present solution, FIGS. 5-11 show different details of a device for operating on products, in particular for packaging articles in boxes, according to an embodiment of the present solution, FIG. 12 is a schematic perspective view of a device for operating on products, in particular for packaging articles in boxes, according to an embodiment of the present solution, FIG. 13 is a cross-sectional view of a detail of FIG. 12, and FIG. 14 is a schematic perspective view of a device for operating on products, in particular for packaging articles in boxes, according to an embodiment of the present solution.

With reference to the enclosed Figures, number 100 globally denotes a device for operating on products made according to the present solution.

Specifically, the device 100 for operating on products shown in the Figures is a device for packaging articles 1 in boxes 2.

Accordingly, the product is represented by the article 1 or box 2, or by the set formed by article 1 and box 2.

With particular reference to FIG. 1, the device 100 comprises a carousel 3 rotatable about a substantially vertical axis of rotation X.

The carousel is rotatably coupled to a stand 3*a* fixed to the ground of the device 100.

The device 100 shown in FIG. 1 comprises a frame 4 provided at the top with a first operating unit 5 made in the form of a support surface on which one or more products, i.e. one or more articles 1 and/or one or more boxes 2, may be placed and/or advanced.

The first operating unit 5 is therefore arranged to operate on at least one product.

The support surface is rigidly connected to the frame 4 and defines a substantially horizontal working surface 5*a* on which one or more articles 1 and/or one or more boxes 2 may be placed and/or advanced.

The articles 1 and boxes 2 are shown for exemplary purposes at least in FIGS. 3 and 4.

With particular reference to FIGS. 1-6, the frame 4 comprises a ring-shaped single-piece body 6 to which the support surface is rigidly connected.

In other words, the support surface is rigidly connected to the frame 4 and defines a substantially horizontal working surface 5*a* on which one or more products may be placed and/or advanced.

The frame 4 comprises a sequence of lightening holes 7 formed in the single-piece body 6 to reduce the overall weight of the frame 4.

The frame 4 is rotatably supported and raised from the ground by the carousel 3 by means of a coupling that allows the relative rotation between the carousel 3 and the frame 4.

Specifically, the axis of rotation of the carousel 3 passes through the centre of the ring-shaped single-piece body 6.

Figure 5:
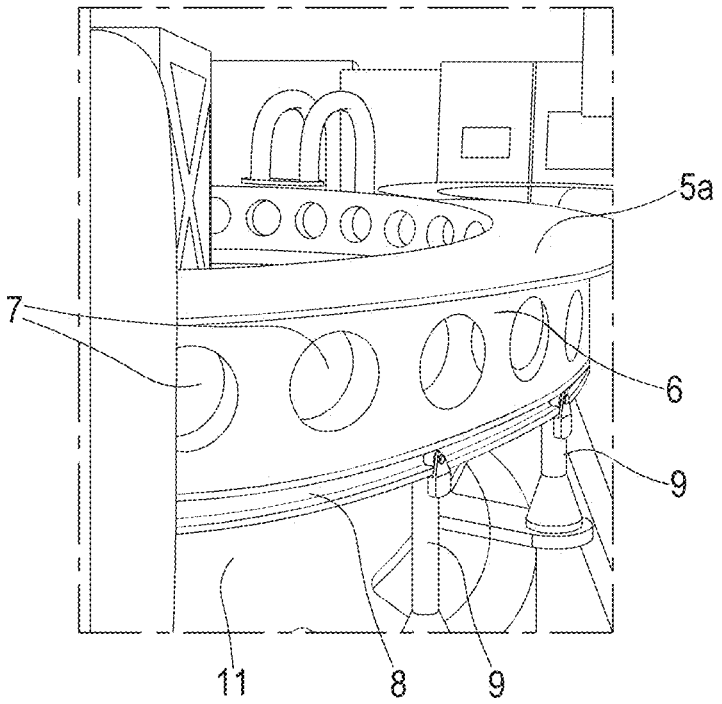
Figure 6:
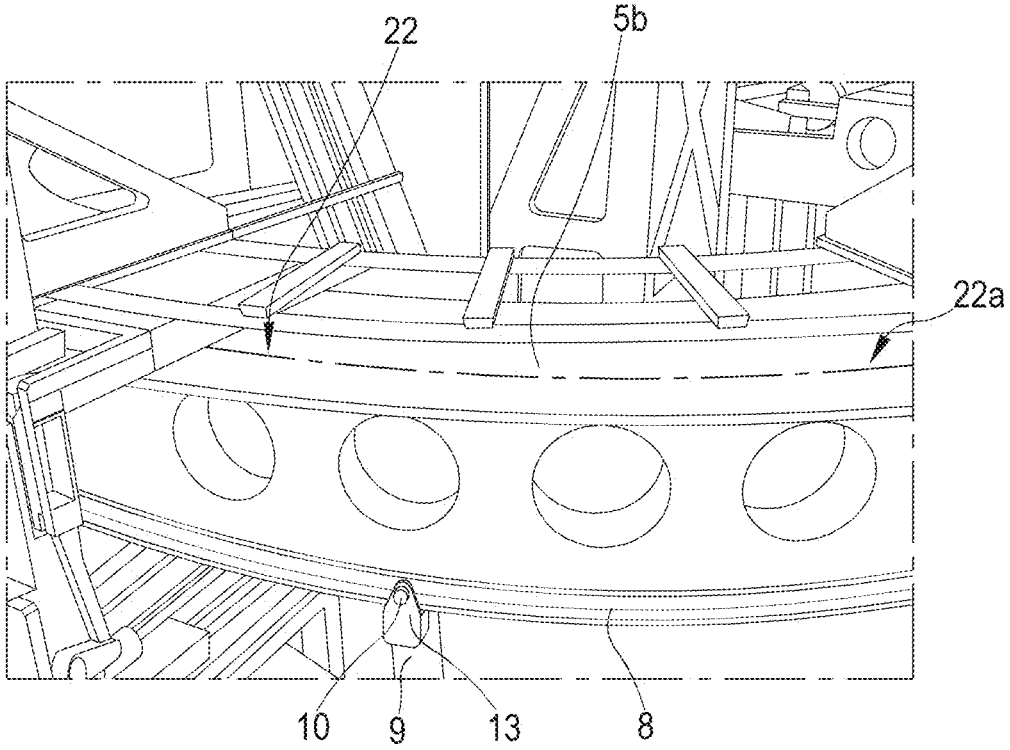
Figure 7:
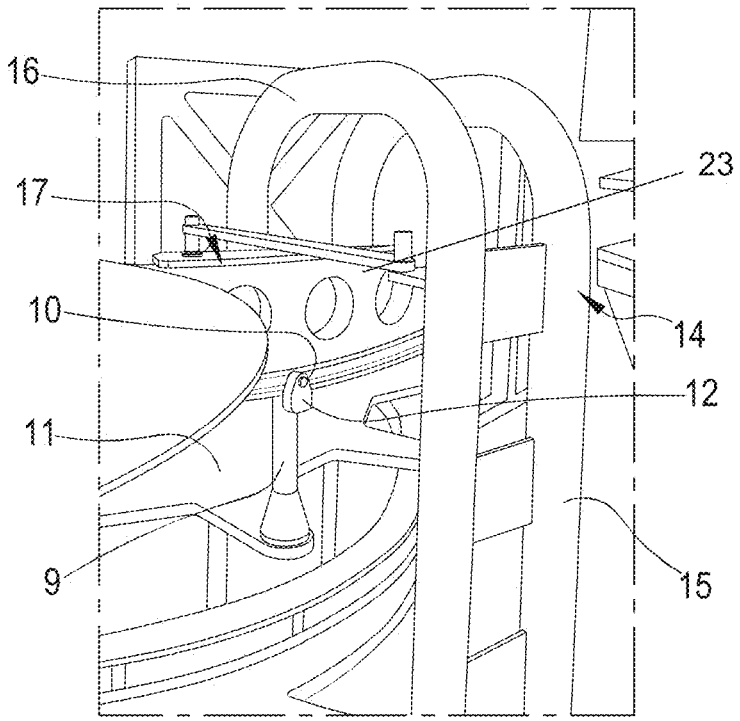

With particular reference to FIGS. 5-7, the frame 4 comprises an annular groove 8 while the carousel comprises a plurality of uprights 9 adapted to rotatably support the frame 4 by means of respective rollers 10 constrained to the relative upright 9 and sliding in the annular groove 8. The annular groove 8 is extended on an outer side surface of the frame 4, i.e. on a surface opposite to that of the frame facing the axis of rotation of the carousel 3. The uprights 9 are arranged radially with respect to the axis of rotation X of the carousel 3.

The carousel 3 comprises a base 11 from which the uprights 9 are extended along a vertical direction to a respective free end 12. The free end 12 is provided with a bracket 13 to which a roller 10 is constrained which is able to rotate around a horizontal axis with respect to the upright 9.

In alternative to the rotatable coupling between the carousel 3 and the frame 4 described above, the frame 4 is rotatably coupled to the carousel 3 by a fifth wheel.

With particular reference to FIGS. 3-6, the support surface comprises at least a curvilinear portion 5*b* extended along a section of the frame 4. The curvilinear portion 5*b* is extended consistently with the arched extension of the frame section below it.

With particular reference to FIG. 7, the device 100 comprises a fixing structure 14 connected to the frame 4 so as to keep the frame 4 fixed to the ground when the carousel 3 rotates about its axis of rotation X. The frame 4 thus remains stationary during the rotation of the carousel 3.

The fixing structure 14 comprises a support 15 with a predominantly vertical extension fixed to the ground and an arm 16 extended from the support 15 and rigidly connected to an upper portion 17 of the frame 4.

The support 15 is spaced from, and arranged externally to, the frame 4 with respect to the axis of rotation X of the carousel 3 and the arm 16 comprises an inverted U-shaped portion.

With particular reference to FIGS. 1-4, the device 100 comprises a plurality of second operating units 18, each one comprising a first member 19 connected to a portion of the carousel 3 below the frame 4 so that the rotation of the carousel 3 about the axis of rotation X moves the second operating unit 18 along a predetermined path 20.

The second operating units 18 are therefore arranged to operate on the products.

Figure 9:
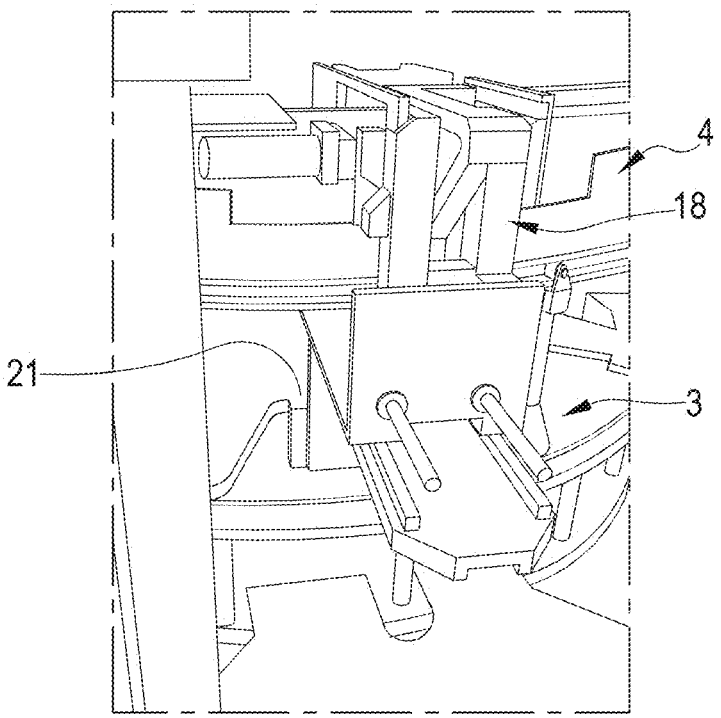

For exemplary purposes, the aforesaid portion of the carousel 3 below the frame 4 is indicated with reference number 21 in FIGS. 9 and 10.

The predefined path 20 has a circular shape and extends along the ring-shaped extension of the frame 4. Thus, the predefined path 20 comprises an extended portion according to an annulus section 20*a*.

With particular reference to FIGS. 3 and 4, the first member 19 is arranged at least partially beyond the frame 4 with respect to the axis of rotation X of the carousel 3 so that the working surface 5*a* is extended between the axis of rotation X and the first member 19 at least in an operating section 22 of the predefined path 20.

The working section 22 corresponds to a curvilinear portion 22*a* of the predefined path 20 and extends along the working surface 5*a*.

With particular reference to FIG. 7, the fixing structure 14 is advantageously connected to a portion 23 of the frame 4 not affected by the operating section 22.

Returning now to the second operating unit 18, it must be noted that it comprises a second member 24 connected to the portion 21 of the carousel 3 and arranged opposite the first member 19 with respect to frame 4.

Specifically, the working surface 5*a* is extended between the first member 19 and the second member 24 at least in the operating section 22 of the predefined path 20.

The device 100 shown in the Figures provides that the first member 19 and the second member 24 of the operating units 18 are configured to operate jointly in the operating section 22 on one or more articles 1 and/or one or more boxes 2 during the movement of the second operating unit 18 along the predefined path 20 when said one or more articles 1 and/or one or more boxes 2 are/is on the working surface 5*a* at the operating section 22.

Figure 8:
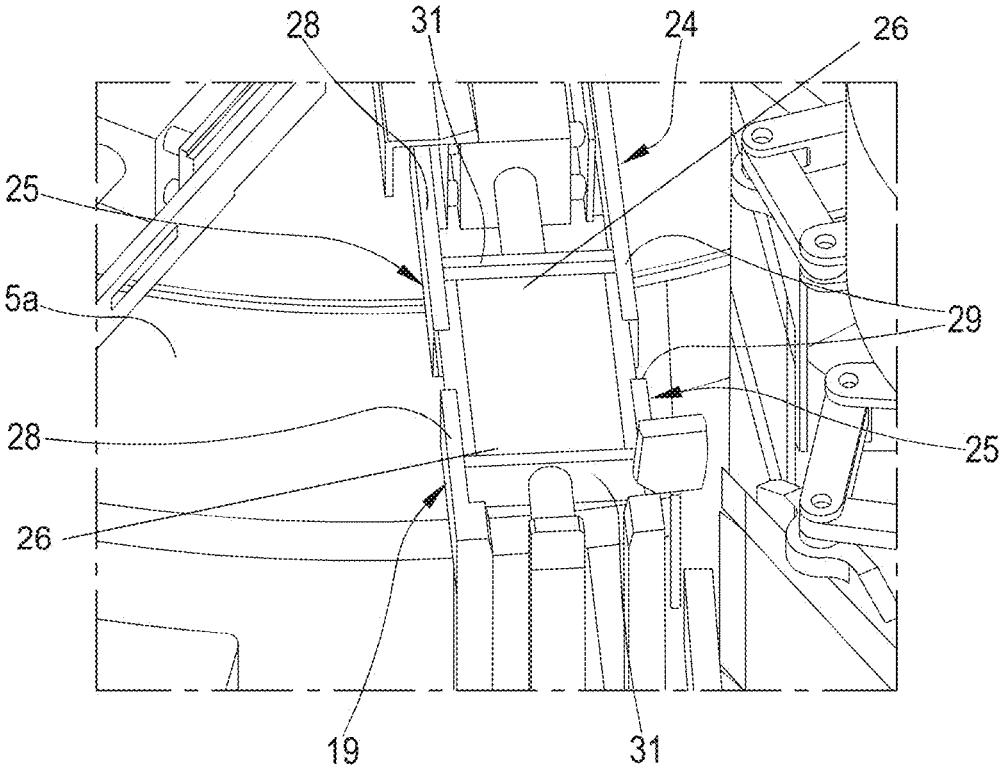

With particular reference to FIG. 8, the first member 19 and the second member 24 comprise a respective head 25 adapted to operate on an article 1 and/or a box 2 present on the working surface 5*a*, each head 25 being above the working surface 5*a* in the operating section 22.

The head 25 of each first member 19 and second member 24 comprises a base 27 and a pair of sidewalls 28, 29 and is adapted to retain and support an end 26 of an article 2 and to provide an appropriate abutment while forming a box 2 around it.

Specifically, the heads 25 of the first member 19 and of the second member 24 jointly define a mandrel 30*a* configured to accommodate and support an article 1 and to promote the formation of a box 2 around it according to a "wrap-around" packaging process.

The head 25 also comprises a piston 31 sliding in a seat 30 and adapted to hold the article 1 in position when it is accommodated in the mandrel 30*a*.

With particular reference to FIG. 11, the frame 4 comprises a ramp 31 extended longitudinally from a first end 32 to a second end 33 thereof above its first end 32, wherein the second end 33 is substantially coplanar to the working surface 5*a*.

FIG. 12 shows an embodiment of the device 100 wherein the frame is rotatably coupled to the carousel by a fifth wheel 34.

The fifth wheel 34 comprises a concentric inner ring 35 and outer ring 36 and rotating elements 37, in particular balls, contained within a seat 38 formed between the inner ring 35 and outer ring 36.

These components are visible in FIG. 13.

The frame 4 is fixed to the outer ring 36 while the inner ring 35 is fixed to a base 39 of the carousel 3 by means of a plurality of arms 40 radially extended with respect to the axis of rotation X of the carousel 3.

FIG. 14 shows an embodiment of the device 100 wherein the frame is rotatably coupled to the carousel by a linear guide 41.

The linear guide 41 comprises a rail 42 fixed to the frame 4 and a plurality of slides 43 fixed to a base 44 of the carousel 3 by respective arms 45 radially extended with respect to the axis of rotation of the carousel 3. The slides 43 are sliding on the rail 42.

A method for packaging articles in boxes by means of the device 100 may therefore provide a step of rotating the carousel 3, e.g. by means of a suitable electric drive, so as to move the operating units 18 along the frame 4. During the rotation of the operating units 18 around the axis of rotation X, the respective heads 25 operate (in particular retain) on the articles 1 and/or boxes 2 on the support surface at the operating section 22.

A further method for operating on products may therefore provide:

- arranging the frame 4 provided with the first operating unit 5,
- arranging the carousel 3 that is rotatable around the substantially vertical axis of rotation X and provided with the second operating units 18,
- rotatably coupling the frame to the carousel so that the frame is supported and raised from the ground by the carousel and a relative rotation between the carousel and the frame is allowed,
- connecting the fixing structure 14 stably to the ground,
- connecting the frame 4 stably to the fixing structure 14 so as to keep the frame 4 fixed with respect to the ground by means of the fixing structure 14 when the carousel 3 rotates around the axis of rotation,
- moving one of the products 1, 2 along the predefined path 20 passing through the first operating unit 5,
- rotating the carousel 3 around the axis of rotation X, and
- operating on the product 1, 2 by means of the first operating unit 5 and a second operating unit 18.

Specifically, the aforesaid method provides that the step of operating on one of the products 1, 2 by means of the first operating unit 5 and the second operating unit 18 is implemented in the operating section 22. In the operating section 22, the product 1, 2 is placed on the working surface 5*a* and thus supported by the first operating unit 5.

The product 1, 2 is advanced on the working surface 5*a* by means of the second operating unit 18 thanks to the heads 25 of the first member 19 and second member 24 which retain the respective ends 26 of the product 1, 2.

The invention claimed is:

1. A device for packaging articles in boxes, comprising:

a carousel rotatable about a substantially vertical axis of rotation, a frame supported and raised from ground by said carousel, a first operating unit arranged to operate on at least one of said articles or one of said boxes, and a fixing structure connected to said frame, wherein:

said carousel is configured to rotate relative to said frame, and said fixing structure is configured to fix said frame with respect to the ground when said carousel rotates around said axis of rotation.

2. The device according to claim 1, further comprising a second operating unit which comprises a first member connected to a portion of said carousel below said frame so that rotation of the carousel around said axis of rotation moves said second operating unit along a predefined path.

3. The device according to claim 2, wherein said first member is arranged at least partially beyond said frame with respect to the axis of rotation so that said first operating unit is extended between said axis of rotation and said first member at least in an operating section of said predefined path.

4. The device according to claim 3, wherein said first member is configured to operate in said operating section on the at least one of said articles or one of said boxes during a movement of said second operating unit along said predefined path when the at least one of said articles or one of said boxes is at said operating section.

5. The device according to claim 2, wherein said second operating unit further comprises a second member connected to said portion of said carousel below said frame and arranged opposite said first member with respect to said frame.

6. The device according to claim 5, wherein said first operating unit is extended between said first member and said second member at least in an operating section of said predefined path.

7. The device according to claim 6, wherein said first member and said second member are configured to operate jointly in said operating section on the at least one of said articles or one of said boxes during movement of said second operating unit along said predefined path when the at least one of said articles or one of said boxes is at said operating section.

8. The device according to claim 1, wherein said first operating unit comprises a working surface on which the at least one of said articles or one of said boxes can be placed or advanced.

9. The device according to claim 6, wherein said first operating unit comprises a working surface on which the at least one of said articles or one of said boxes can be placed or advanced, and wherein at least said first member or said second member comprises a relative head adapted to operate on the at least one of said articles or one of said boxes present on said working surface, said head being above said working surface in said operating section.

10. The device according to claim 9, wherein said head is adapted to retain one end of said at least one of said articles or one of said boxes.

11. The device according to claim 1, wherein said frame comprises an annular groove and said carousel comprises at least one upright configured to rotatably support said frame by at least one roller constrained to said at least one upright and configured to slide in said annular groove.

12. The device according to claim 1, wherein said frame is rotatably coupled to said carousel by a fifth wheel.

13. The device according to claim 1, wherein said frame comprises a ramp extending longitudinally from a first end of the ramp to a second end of the ramp, said second end being above said first end and substantially coplanar with a working surface.

14. The device according to claim 1, wherein said frame has a ring shape.

15. The device according to claim 8, wherein said working surface comprises at least one curvilinear portion.

16. The device according to claim 2, wherein said predefined path comprises a portion extended according to an annulus section or said predefined path has a ring shape.

17. The device according to claim 3, wherein said operating section comprises at least a curvilinear portion of said predefined path.

18. The device according to claim 1, wherein said fixing structure comprises a support with a vertical extension fixed to the ground and an arm integrally extended by said support and rigidly connected to an upper portion of said frame.

19. The device according to claim 3, wherein said fixing structure is connected to a portion of said frame not affected by said operating section of said predefined path.

20. A method for packaging articles in boxes, comprising:

arranging a carousel rotatable around a substantially vertical axis of rotation, arranging a frame having a ring shape and provided at a top of the frame with a first operating unit arranged to operate on at least one of said articles or one of said boxes, said frame fixed with respect to ground, arranging a second operating unit comprising a first member and a second member, the first member and the second member constrained to said carousel in a position below said frame, said second member opposed to said first member with respect to said frame, rotating said carousel to move said second operating unit along a predefined path extended along said frame, and operating on said at least one of said articles or one of said boxes present at said predefined path by said second operating unit.

* * * * *